United States Patent [19]

Fisher

[11] 4,037,584

[45] July 26, 1977

[54] STOVE DAMPER ASSEMBLY

[76] Inventor: Baxter Fisher, Rte. 3, Box 285, Springfield, Oreg. 97477

[21] Appl. No.: 743,233

[22] Filed: Nov. 18, 1976

[51] Int. Cl.[2] ..... F24C 15/20

[52] U.S. Cl. ..... 126/290; 251/88; 251/216

[58] Field of Search ..... 126/285 R, 289, 290, 126/293; 251/84, 88, 145, 216; 85/32 W

[56] References Cited

U.S. PATENT DOCUMENTS

| | | | |
|---|---|---|---|
| 2,059,793 | 11/1936 | Hunker | 126/290 |
| 2,517,816 | 8/1950 | Weyenberg et al. | 126/290 |
| 3,827,596 | 8/1974 | Powers, Jr. | 251/216 |

*Primary Examiner*—Ronald C. Capossela
*Attorney, Agent, or Firm*—James D. Givnan, Jr.

[57] ABSTRACT

A stove damper is adjustably supported on a stationary shaft secured to a stove door or wall. Front and rear recesses in the damper are defined by annular walls radially spaced from the damper supporting shaft. Intermediate the front and rear recesses is a shaft engaging member which retards heat transfer, enabling comfortable grasping of the damper regardless of high stove temperatures.

4 Claims, 3 Drawing Figures

STOVE DAMPER ASSEMBLY

BACKGROUND OF THE INVENTION

The present invention generally concerns stove or furnace structure and particularly a damper assembly for use in conjunction therewith.

For purposes of fuel conservation it is important that the flow of combustion air into a firebox be regulated to provide the desired combustion. Well-known are draft controls having a shaft in threaded engagement with a stove wall or stove door. A problem encountered with such known arrangements is that the cooperating threaded elements often become fouled with combustion residue to render damper adjustment difficult. A further problem commonly encountered in conventional dampers is that the manipulated portion of the damper is often hot to the touch necessitating the use of a towel or rag as an insulator.

SUMMARY OF THE PRESENT INVENTION

The present invention is embodied in a damper assembly adapted for opening and closing movement along a fixed shaft projecting outwardly from a stove door or wall member. A shaft engaging component of the damper is preferably a nut element which, by reason of its size, minimizes the conduction of heat to the remaining damper structure. Recesses of opposite ends of the damper additionally minimize heat transfer. To assure comfortable grasping of the damper, heat radiating fins are provided which also enable foot control of the damper.

Important objectives of the present invention include: the provision of a damper at all times supported in a freely adjustable manner for precise movement toward and away from a vent opening; the provision of a damper having relatively large heat dissipating fins which render the damper at all times cool to the touch and adjustable by foot action, if desired; the provision of a balanced damper supported at or near its center of gravity on a shaft thereby contributing to ease of damper adjustment; the provision of a damper rotatably mounted on a stationarily supported shaft with locking means securing said shaft to a stove wall or door member.

DETAILED DESCRIPTION OF THE PREFERRED EMBODIMENTS

Figure 1:
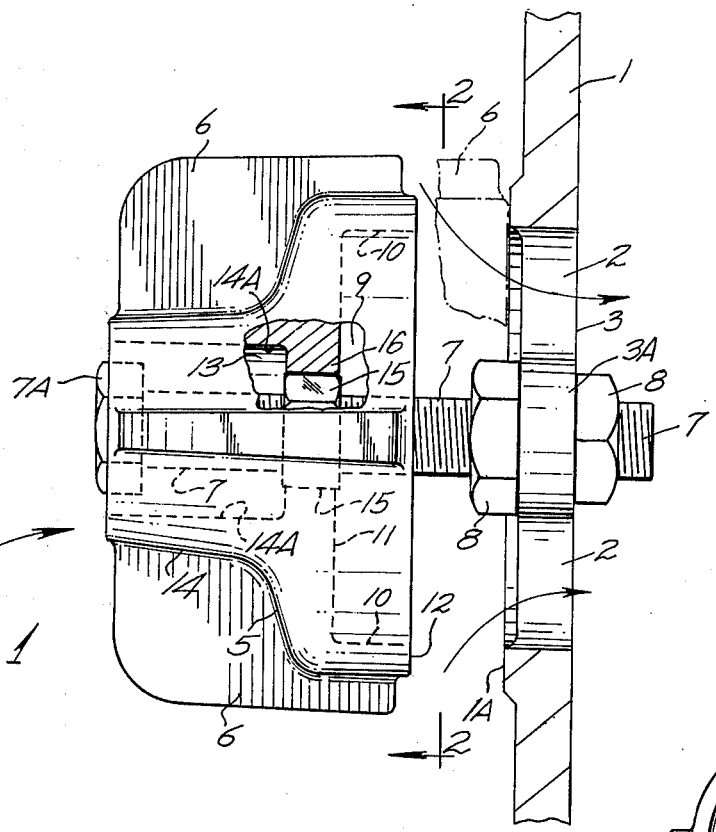
FIG. 1 is a side elevational view of the present damper assembly with fragments broken away for purposes of illustration.
Figure 2:
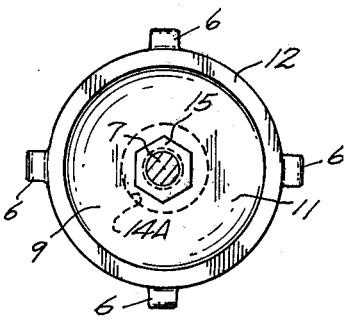
FIG. 2 is a sectional elevational view taken along line 2—2 of FIG. 1.
Figure 3:
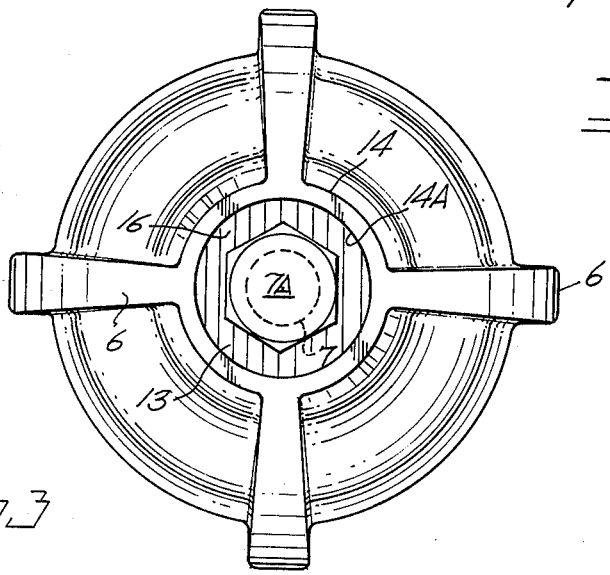
FIG. 3 is a rear elevational view of the left hand side of FIG. 1.

With continuing attention to the drawings, the reference numeral 1 indicates a stove door or wall member of a stove which may be of the type useable within the home for heating as well as cooking purposes. The stove defines a vent opening 2 having a bridge or spider 3 thereacross having an enlargement at 3A to receive a later described shaft. An airflow, supporting stove combustion, is typically indicated by applied arrows.

Indicated generally at 4 is the present damper assembly which includes a damper 5 of cast construction and having a series of heat dissipating fins at 6. A damper support shaft at 7, which may be lengthwise threaded, is secured to the stove door or wall by jam nuts 8 which bear against opposite sides of bridge 3 and serve as locking means. A front recess 9 is defined by an annular wall 10 and an end wall 11. Annular wall 10 has frontal edge 12 which may be advanced into abutment with a raised circular area 1A of the stove to effect an airtight seal to block vent opening 2.

A rearward or outer tubular portion of the damper 14 has an inner wall 14A which defines a rear recess indicated at 13. Recess 13 is of a size to admit enlarged limit stop means 7A of damper shaft 7 during damper adjustment. Heat radiated by the damper shaft is, for the most part, dissipated within rear recess 13 by reason of the radially spaced annular wall 14A.

Within the damper is a shaft engaging traveler 15 secured in place intermediate the recesses during casting. Traveler 15 is shown, cast in place, as a nut but may be otherwise embodied as, for example, in a collar of approximately the same lengthwise dimension. Importantly, traveler 15 is of minimal length to restrict heat condition to an internal flanged portion 16 of the damper while yet providing for precise movement of the damper along shaft 7 without wobble.

The fins at 6 provide fingergrips which, at all times, remain comfortable to the touch regardless of stove temperatures. The fins extend in a fore and aft direction substantially the length of the damper and serve to dissipate damper heat by reason of their substantial surface area. The fins, also by reason of their size, permit damper control by foot action, if desired.

In use, the damper assembly is bolted to the stove door or wall member by jam nuts 8. The length of shaft 7 is exterior of the firebox and hence not susceptible to combustion deposits which would otherwise interfere with damper travel along the shaft. Heat imparted to shaft 7 may be conducted only via relatively small traveler 15 which heat is rapidly radiated by fins 6. Firebox heat radiated onto recess end wall 11 is also dissipated by said fins to, at all times, provide a damper comfortable to the touch. Rear recess 13 is of a size to further minimize heat transfer by radiation to the damper.

While I have disclosed but a few embodiments of the invention it will be apparent to those skilled in the art that the invention may be embodied still otherwise without departing from the spirit and scope of the invention claimed.

Having thus described the invention what is desired to be claimed and secured under a Letters Patent is:

1. A damper assembly for vented stoves and furnaces and comprising in combination, a threaded shaft projecting outwardly from a vent defining upright member, means at the outer end of said shaft limiting outward damper movement, locking means in place on said shaft lockably securing same to said upright member, and a damper in supported engagement with said shaft and adapted to be positioned therealong to open and close said vent, said damper including front and rear internal wall surfaces defining front and rear damper recesses, an internal flange intermediate said recesses, traveler means disposed on said flange intermediate said front and rear recesses and in axially adjustable engagement with said shaft whereby surface contact and conductance of heat to the damper from said shaft is restricted to said traveler means to minimize damper heating.

2. The damper structure claimed in claim 1 wherein said damper additionally includes radially disposed heat dissipating fins extending substantially the length of the damper.

3. The damper assembly claimed in claim 1 wherein said rear damper recess is of a size to admit entry of the outer end of said shaft and the limiting means thereon during opening movement of the damper.

4. The damper assembly claimed in claim 1 wherein said traveler means is located at the damper center of gravity to assure ease of damper movement along said threaded shaft.

* * * * *